United States Patent [19]

Worrell et al.

[11] 4,147,036

[45] Apr. 3, 1979

[54] SCISSOR WELL TEMPLATE

[75] Inventors: J. Robert Worrell; Mark Y. Berman, both of Tulsa, Okla.

[73] Assignee: Standard Oil Company (Indiana), Chicago, Ill.

[21] Appl. No.: 830,223

[22] Filed: Sep. 2, 1977

[51] Int. Cl.[2] ..... E02B 17/02

[52] U.S. Cl. ..... 405/205; 166/366; 175/7; 408/241 G; 405/228

[58] Field of Search ..... 61/86, 87, 88, 89, 94, 61/95, 98, 99, 100; 114/264; 166/366; 175/7

[56] References Cited

U.S. PATENT DOCUMENTS

| | | | |
|---|---|---|---|
| 2,608,829 | 9/1952 | Knapp | 61/88 |
| 2,675,681 | 4/1954 | Dawson | 61/89 |
| 3,922,868 | 12/1975 | McDonald et al. | 61/95 |
| 3,934,658 | 1/1976 | Nelson | 175/7 |
| 4,000,624 | 1/1977 | Chow | 61/94 X |

*Primary Examiner*—Mervin Stein
*Assistant Examiner*—David H. Corbin
*Attorney, Agent, or Firm*—John D. Gassett

[57] ABSTRACT

A scissored sea-floor well template for positioning spacing of subsea wells or piling in the sea floor. Two arms, each having a pontoon template at each end thereof, are pivotally connected. The two arms are rotated about the pivot to a closed position for transportation to the marine site at which they are to be used. Inasmuch as the template is provided with pontoons, it can be towed and does not have to be loaded on a barge although it could be. Upon reaching the well site the arms are opened so that the pontoon templates assume the desired shape. The arms are then locked in this extended position and the scissor well template is then lowered to the ocean floor.

4 Claims, 10 Drawing Figures

SCISSOR WELL TEMPLATE

BACKGROUND OF THE INVENTION

1. Field of Invention

This invention relates to a sea-floor template for the drilling of boreholes or installing piles in the ocean floor. It relates especially to a floating template that has scissored arms with flotation means for ease of transportation.

In recent years there has been considerable attention attracted to the drilling and production of wells located in water. Wells may be drilled in the ocean floor from either fixed platforms in relatively shallow water or from floating structures and vessels in deep water. The most common means of anchoring fixed platforms includes the driving or otherwise anchoring of long piles in the ocean floor. Such piles normally extend above the surface of the water and support platforms attached to the top of the pile. This works fairly well in shallow waters, but as the water gets deeper the problems of design and accompanying cost become prohibitive. In deeper water, it is common practice to drill from floating structures.

In recent years there has been considerable attention directed toward many different kinds of floating structures. One system receiving attention is the so-called Vertically Moored Platform. Such a platform is described in U.S. Pat. No. 3,648,638, issued Mar. 14, 1972, Kenneth A. Blenkarn, inventor. A chief feature of the disclosure in that patent is that the floating platform is connected to an anchor only by elongated parallel members and the floating structure has buoyancy means designed especially with respect to the trough of the design wave so as to minimize variations in vertical forces imposed on the vertically elongated members which may be caused by passing waves. There are other types of floating drilling vessels, such as the semisubmersible and the floating drilling vessel with a moonpool or vertical opening through the center through which drilling operations are carried out. The drilling engineer selects a floating vessel which he believes will best fit the environmental conditions which are expected to be encountered. A typical subsea floor well pattern for a Vertically Moored Platform is a group of eight wells in a circular pattern at each corner of a square. The template of the present invention can be used to establish such a pattern.

2. Prior Art

The closest prior art relating to our invention, to the best of our knowledge, concerns templates or frames on the ocean floor having a vertical passage through which a well may be drilled. The prior art template would be fabricated in a fabrication yard as a fixed structure. It would be transported to a well site at the selected marine location and lowered to the sea floor. None of the prior art of which we are aware has a template composed of scissor-like arms pivoted about a scissor pivot.

BRIEF DESCRIPTION OF THE INVENTION

This concerns a scissor well template for use as a guide in drilling boreholes or installing piles in a sea floor, particularly beneath a floating drilling platform. It has in a preferred embodiment, two long scissor arm frames connected by a scissor pivot at about the midpoint of each such arm. At the end of each arm there is a pontoon template which has a plurality of vertical well or pile guide slots therethrough which, when the template is set in place, serves as well or pile guides. As the name implies, the pontoon template has a pontoon and the buoyancy of the pontoons are sufficient to float or support the entire scissor well template. When the device is first built the scissor frames are rotatable about the scissor pivot so as to form a compact unit in a closed position. Locking means are provided to lock the arms in the closed position. The device is then towed to the desired well location. At this point the scissor rings are unlocked from each other and pontoons or boats attach lines to the different pontoon templates and opens up the arms. The arms are then locked in their opened or extended positions. Thereafter, the pontoon templates are flooded with seawater and the scissor ocean floor well template is lowered to the sea floor.

Once the scissor well template is in position on the sea floor, it is then used in any manner desired to drill boreholes through the guide slot or well slots in the pontoon templates. The overall template then assures that the location of the boreholes drilled at this location of the template are in the proper relationship to each other.

A better understanding of the invention may be had from the following description taken in conjunction with the drawings.

DRAWINGS

DETAILED DESCRIPTION

Figure 1:
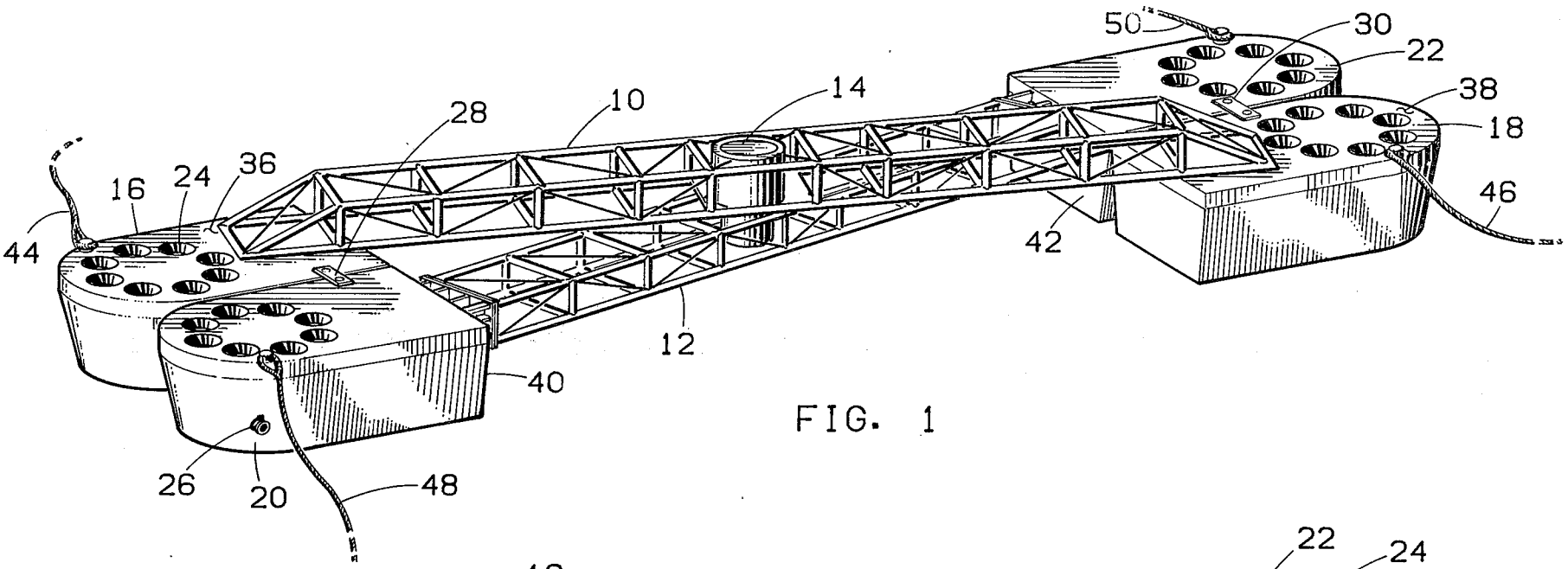
FIG. 1 illustrates in an isometric view the template of the present invention is a closed position.
Figure 3:
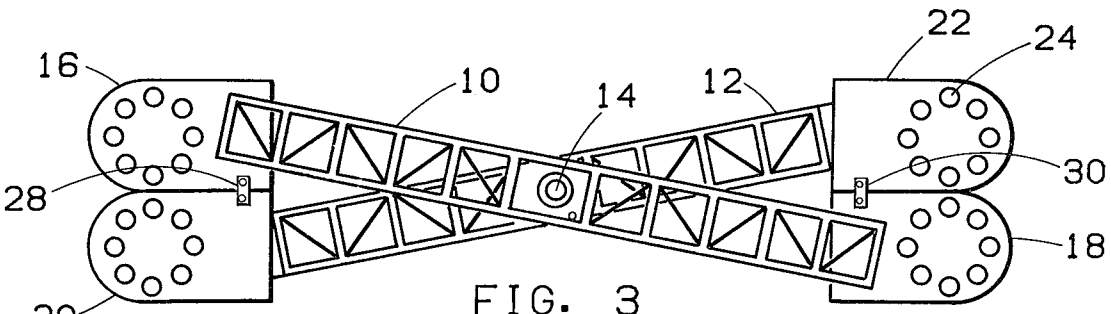
FIG. 3 is a plan view of the scissor ocean-floor well template.
Figure 2:
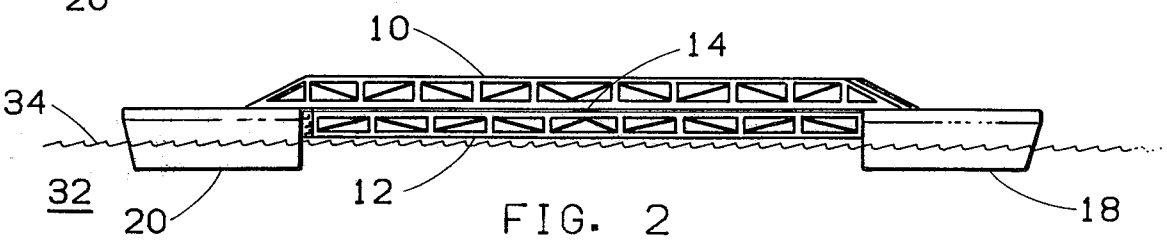
FIG. 2 is a side view of the scissor well template of FIG. 1.

Attention is now directed primarily to FIGS. 1, 2, and 3 which show the scissor well template. Shown thereon is a first arm 10 and a second 12 which are connected by pivot means 14. A pontoon template 16 is at one end of arm 10 and a pontoon template 18 is at the other end. Likewise, arm 12 has at its ends pontoon templates 20 and 22. Each pontoon template is provided with a plurality of well slots 24, which are arranged in any desired pattern. A most common pattern is in a circular manner. These well slots 24 can be, for example, large diameter pipes which are flared at the top. Slots 24 can be used to guide or position drilling equipment, casing or piles. Each pontoon has a flooding valve 26 which can be remotely controlled, if desired. The pontoons 16, 18, 20, and 22 can be made of steel or reinforced concrete to form an enclosed compartment. Arms 10 and 12 can be made of steel and can be hollow pipe, or other structural members known to civil engineers. When the arms 10 and 12 are in their closed position as shown in FIG. 1, they may be locked together such as by locking means or bolting means 28 and 30 on the pontoons 16 and 20, and 18 and 22, respectively.

As can be seen in FIG. 2, the pontoon floats on water 32 having surface 34. It is also seen in FIGS. 1 and 2 that the arms 10 connect to pontoon template 16 and 18 on the top surface 36 and 38 thereof. Lower arm 12 connects into the end 40 and 42 of pontoon templates 20 and 22. This is merely to permit rotation of scissor arms 10 and 12.

Figure 4:
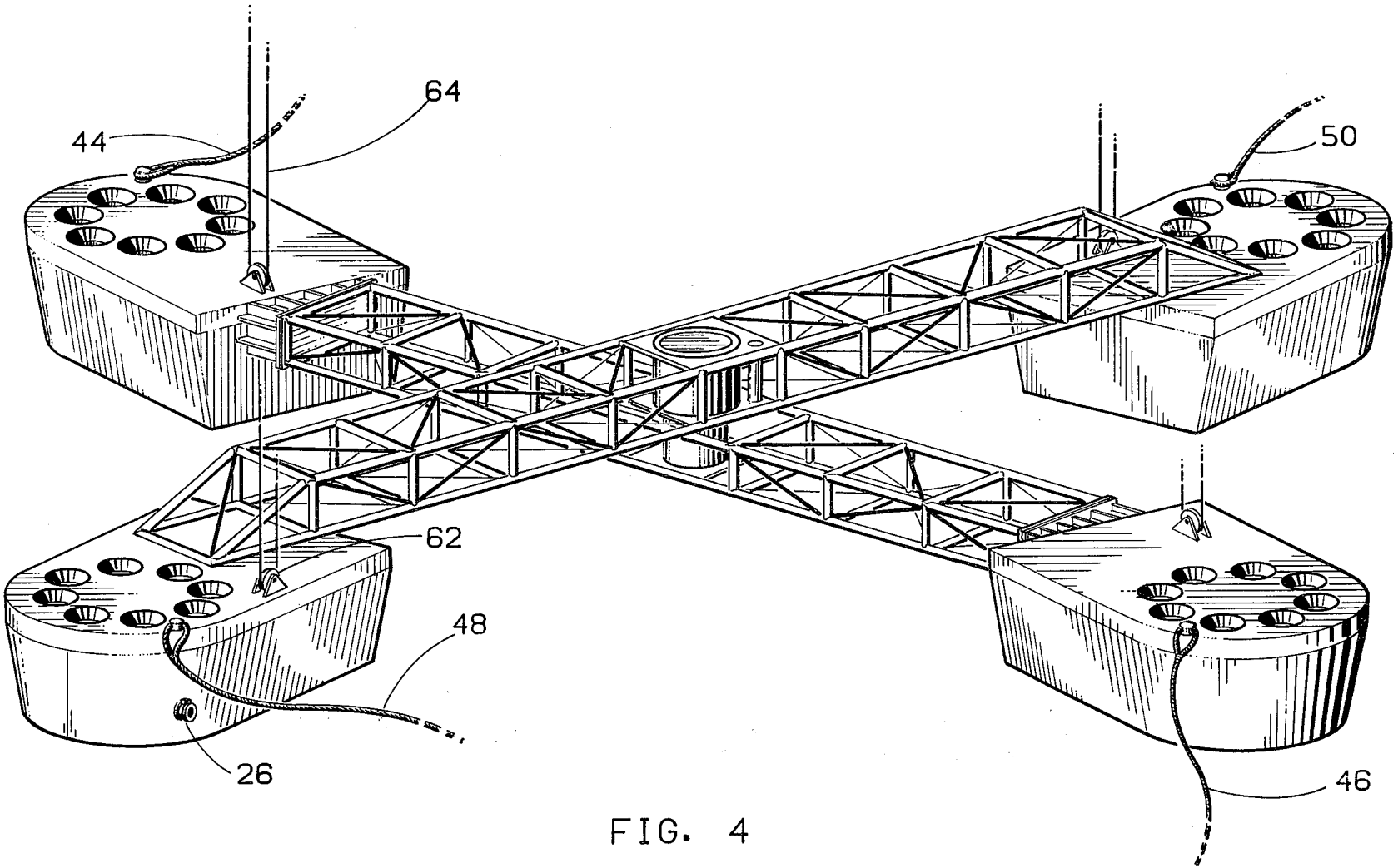
FIG. 4 illustrates the scissor well template of FIG. 1 in expanded or open position.
Figure 5:
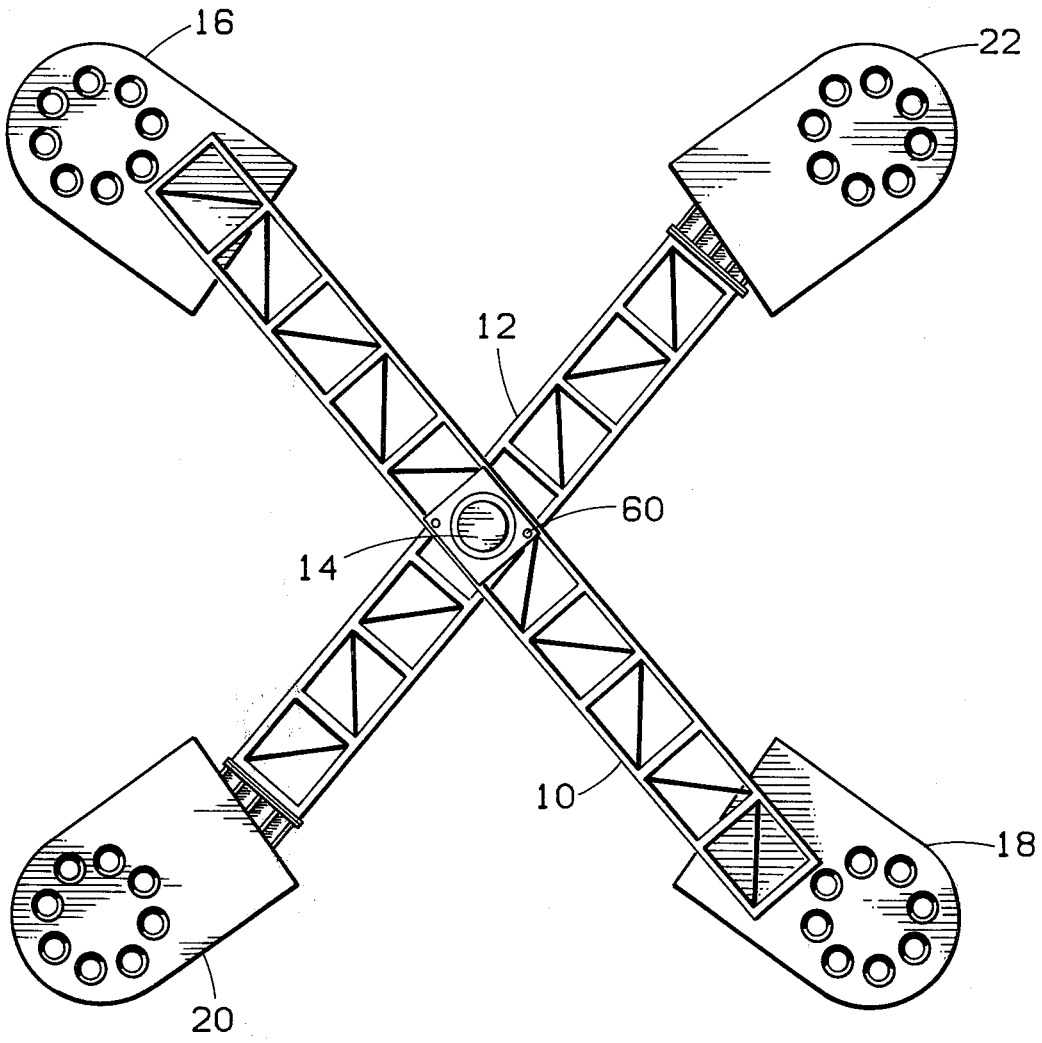
FIG. 5 is a plan view of the scissor well template of FIG. 4.

The scissor well template is towed to the drilling site in the closed position as shown in FIGS. 1, 2, and 3. It is noted that it could be transported on a barge in the closed position, but that would lose part of the advantages which can be obtained from floating it. Upon reaching the drilling site, locking means 28 and 30 are removed. At this time, lines, which may be strong cables, 44 and 46 are connected to pontoon templates 16 and 18, respectively, and lines 48 and 50 are connected to pontoon templates 20 and 22, respectively. Tug boats then pull on these lines until the scissor frame or scissor well template is in the position shown in FIGS. 4 and 5. At this time, locking pins 60 are set through arms 10 and 12 to lock the device in its opened position. Alternatively, the scissor arms can be opened by means other than use of tub boats. For example, hydraulic jack means connected between arms 10 and 12 can be used to force the arms open. Also, powered gear means can be used such as in association with the pivot means. It can be seen in FIG. 5 that the center of the pontoon templates define approximately a square. Any configuration can be obtained which is desired. When the device is in the position shown in FIG. 4, it is ready to be lowered to the ocean bottom. A sheave 62 is attached to the top of each pontoon template. A lowering line 64 is run down through the sheave 62 and is connected to winches on a barge. Flooding is accomplished by opening valves 26, with which each pontoon template is provided. The template then starts to submerge. Lines 64 are payed out until the scissor well template is located on the sea floor. At this time a survey can be run to determine that the template is in the proper position. When the device is on bottom and it is confirmed that it is in the proper position, line 64 then is removed. At this time, the scissor well template is in position and ready for use. A drill pipe can be guided into well slots 24 in any well-known manner, such as subsea TV cameras, divers, etc.

Figure 6:
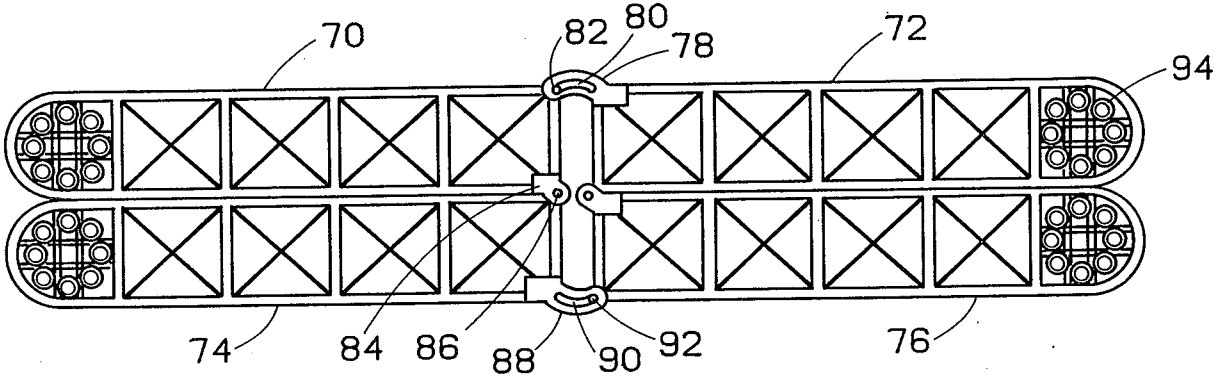
FIG. 6 is a plan view of a modification of the template of the present invention.
Figure 7:
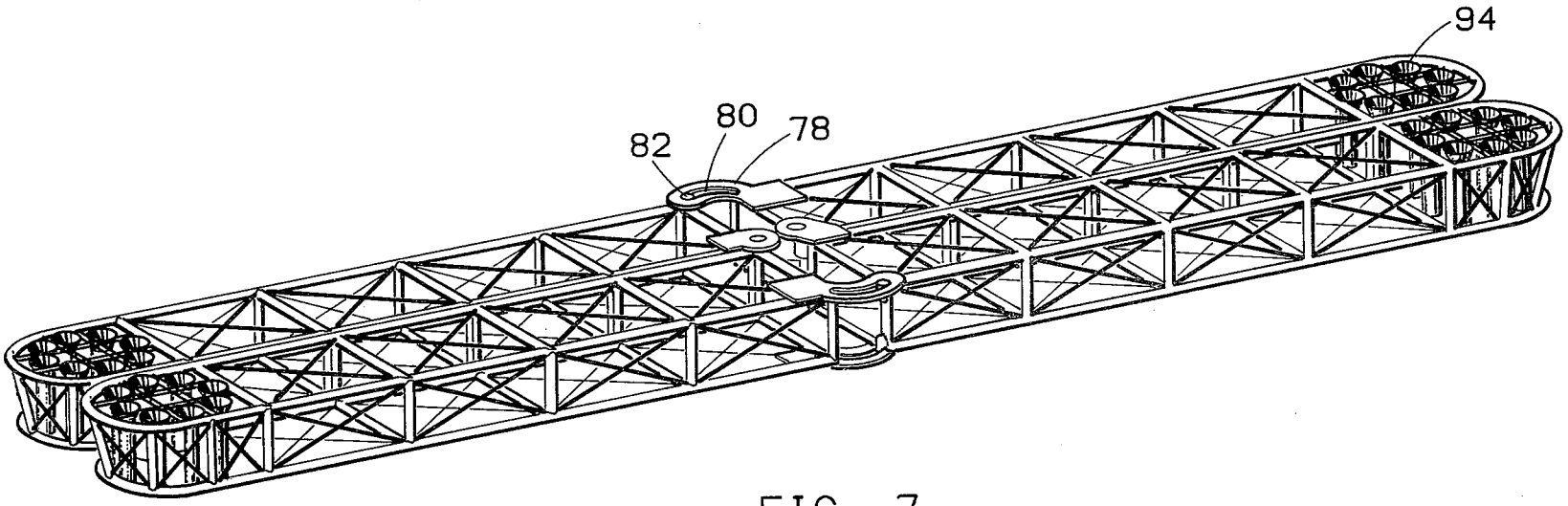
FIG. 7 is an isometric view of the template shown in FIG. 6.
Figure 8:
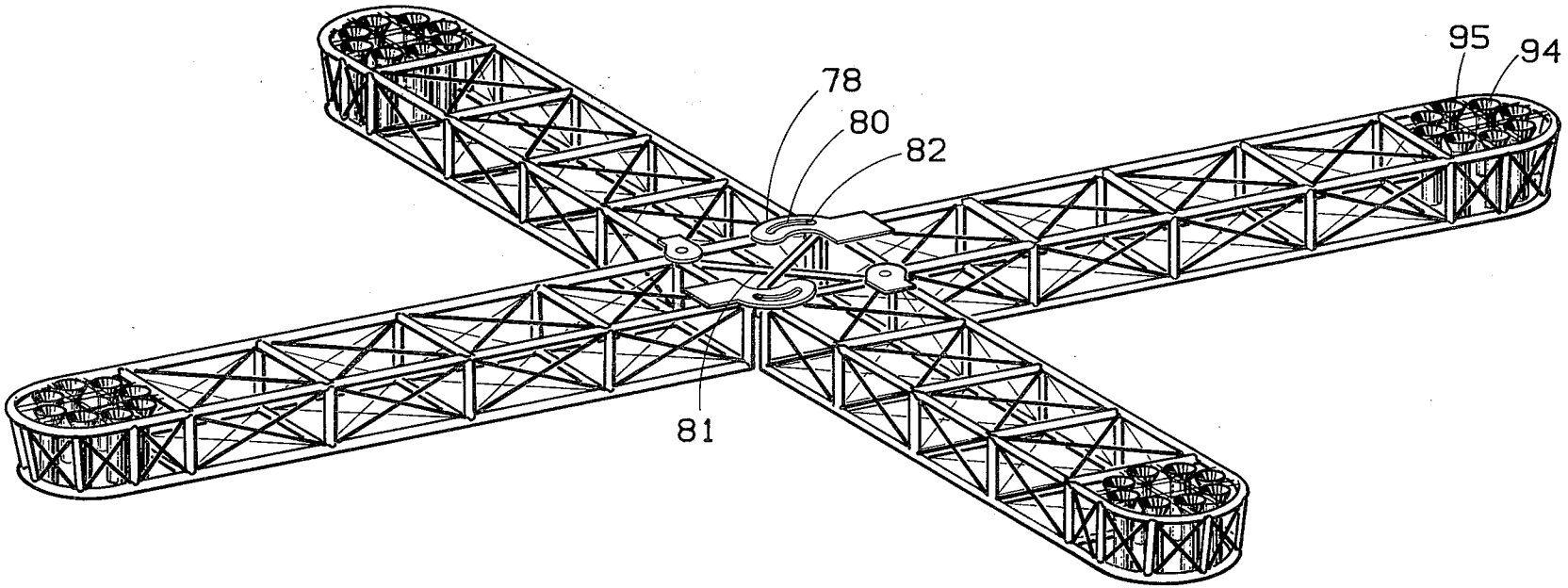
FIG. 8 illustrates the template shown in FIG. 7 in an open position.

Attention is directed to FIGS. 6, 7, and 8 which show a different embodiment of this invention. Shown in FIG. 6 are four arm members, 70, 72, 74, and 76, which are expandable to the position shown in FIG. 8 make up a sea floor template for the controlled spacing of well locations on the sea floor. The outer end of each arm is provided with a well template made up of well slot 94 arranged in a circular or other selected pattern. The arms 70, 72, 74, and 76 are made of frame members which can be large diameter pipe which has sufficient buoyancy to support the structure.

The inner end of arm 72 is provided with a slotted hinge 78 having slot 80. Arm 70 is provided with a pin 82 which fits into slot 80. The middle end of arm 74 is likewise provided with a slotted hinge 88 having slot 90. The middle end of arm 76 is provided with a pin 92 which fits into slot 90. The middle interior corners of arms 70 and 74 are hinged by a hinge member 84 on arm 70 and a hinge pin 86 on arm 74. A similar hinge arrangement is provided on the interior middle ends or corners of arms 72 and 76.

The arms 70, 72, 74, and 76 can be locked into position shown in FIGS. 6 and 7 for transportation. The template can be floated and towed during transportation or the folded template can be placed on a barge and transported in that manner.

When the folded sea floor template, FIGS. 6 and 7, has reached its destination, it is opened to the position shown in FIG. 8. This can conveniently be accomplished by applying force to the outer ends of each arm 70, 72, 74, and 76 in the proper direction. A convenient way of doing this is to tie a line to each such end and open the arm with a force on each line such as by pulling with a tugboat. Once the sea floor template is opened to its desired position, as for example when the templates 95 on the outer end of each arm define a square, locking bars 81 can be added to lock the device in position. Once it is locked in position, the device or sea floor template is lowered to the sea floor by use of cables in a known manner. If hollow tubing is used as the flotation means, such tubing can be flooded through remotely controlled valves not shown to cause the template to submerge. Once on the floor, the template is then used in a known manner to give proper positioning of wells to be drilled in the sea floor through the well slots 94.

Figure 9:
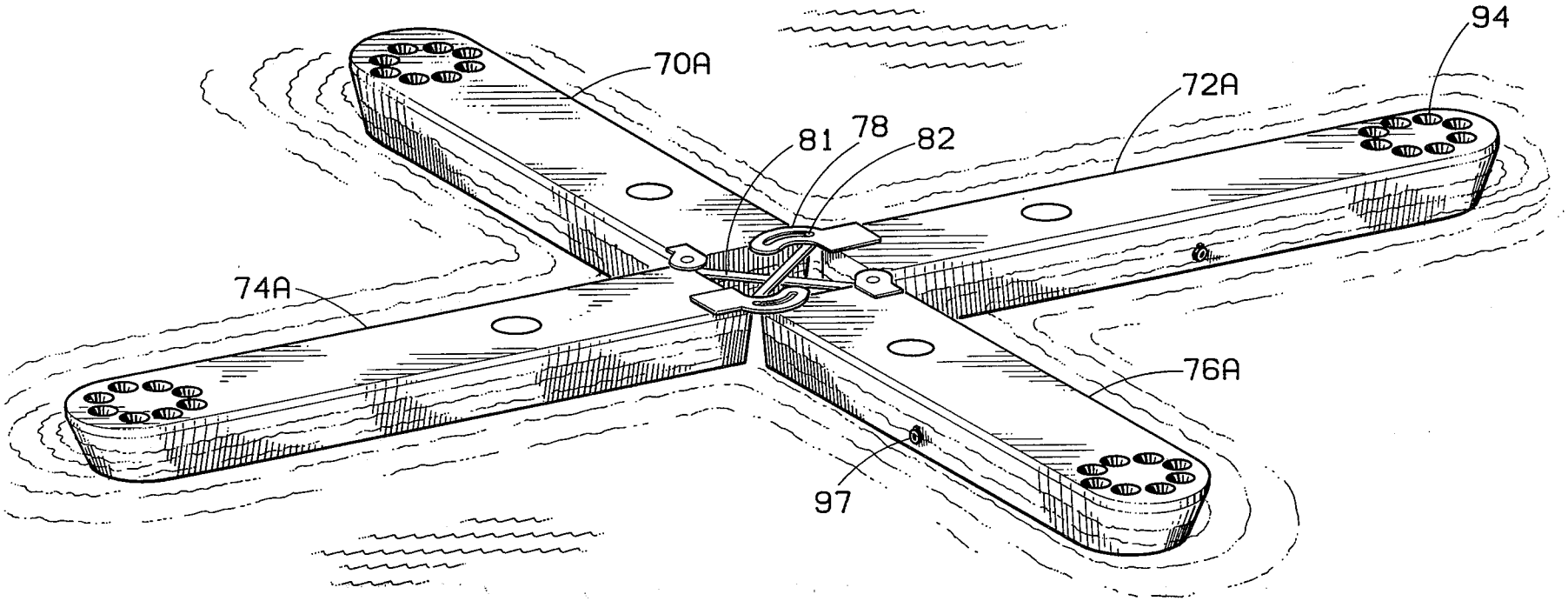
FIG. 9 is an isometric view of a modification of the template shown in FIG. 8.
Figure 10:
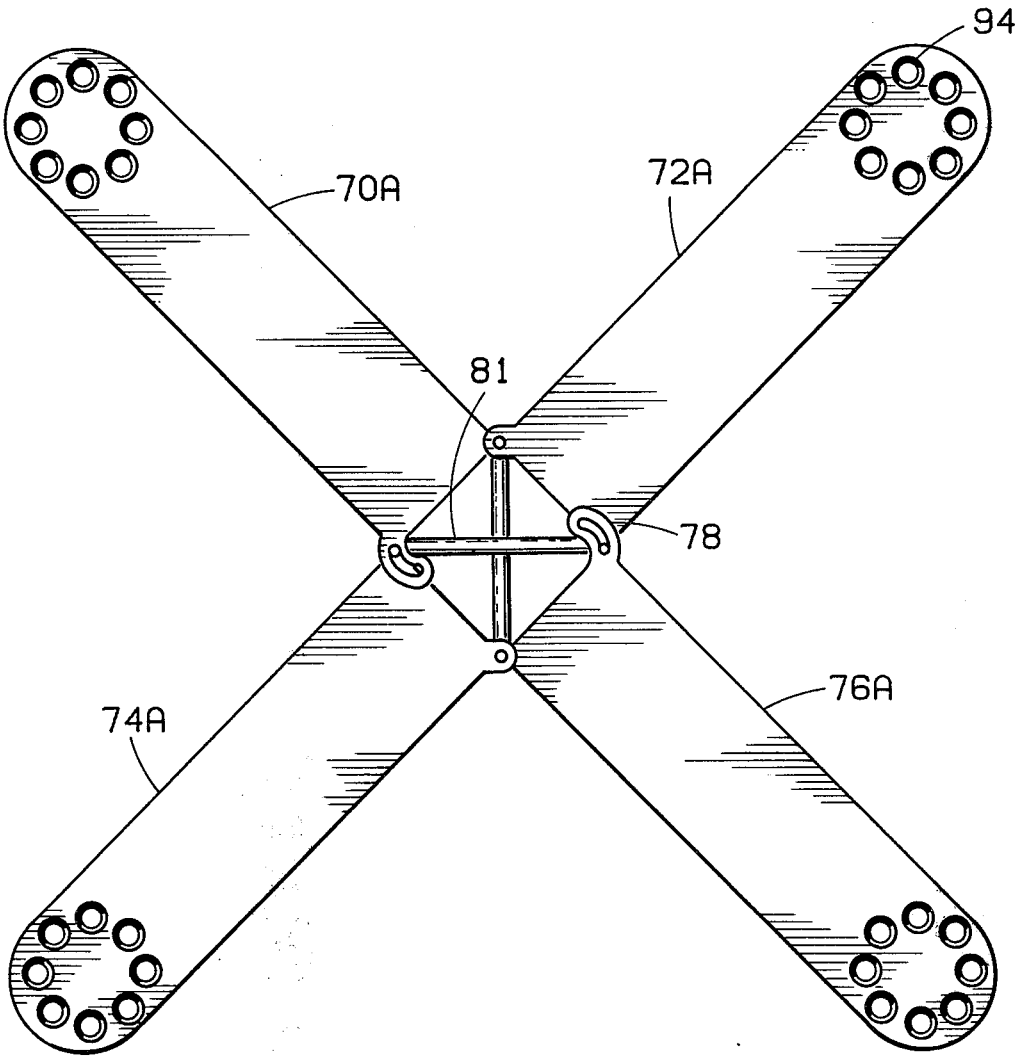
FIG. 10 is a plan view of the template shown in FIG. 9.

Attention is next directed to FIGS. 9 and 10 which show a template which is quite similar to the sea floor template just described, except that each arm 70A, 72A, 74A, and 76A is enclosed to form compartments which then forms the flotation means for the unit. These arms are hinged in a manner which can be identical to that described above in regard to FIGS. 6 and 7. It also has the well slots 94 in the outer ends of each arm. Also shown in FIG. 9 are flooding valves 97 which can be remotely controlled.

When the device in FIG. 9 has been transported, it can be done in a closed manner such as in FIG. 7. When it reaches its destination, it is then expanded or opened to the position shown in FIGS. 9 and 10. FIG. 10 is merely a plan view of the device shown in FIG. 9.

While the above descriptions have been made in detail, it is possible to make various modifications to the invention described above without departing from the spirit or scope thereof.

What is claimed is:

1. A well template for use as a guiding means in the drilling of wellbores or installation of piles in the sea floor which comprises:

a first arm member;

an arm member well template at one end of and fixed to said first arm member;

a second arm member;

a second arm member well template at at least one end of and fixed to said second arm member;

flotation means for supporting said first arm member and said second arm member;

pivot means intermediate the ends of said arm members and connecting said first arm member and said second arm member.

2. A scissor well template for use as a guidance means in positioning wells or piles in a sea floor, which comprises:

a first elongated arm member;

a pontoon template having slots therethrough at each end of said first arm member and fixed thereto;

a second arm member;

a second pontoon template having slots therethrough at each end of said second arm member, said pontoon templates having sufficient flotation to support said scissor well template;

pivot means connecting said first arm member and said second arm member intermediate the ends of said arm members;

said pivot means having only one axis of rotation, said axis being essentially parallel to the axis of the slots in said pontoon templates.

3. A scissor well template as defined in claim 2 including locking means to lock said arms in a closed position.

4. A scissor well template as defined in claim 3 including locking means to lock said arms in an open fixed position.

* * * * *